US009192272B2

(12) United States Patent
Ota

(10) Patent No.: US 9,192,272 B2
(45) Date of Patent: Nov. 24, 2015

(54) ROBOT CLEANER AND DUST DISCHARGE STATION

(75) Inventor: Tetsu Ota, Sagamihara (JP)

(73) Assignee: Life Labo Corp., Sagamihara, Kanagawa (JP)

( * ) Notice: Subject to any disclaimer, the term of this patent is extended or adjusted under 35 U.S.C. 154(b) by 1045 days.

(21) Appl. No.: 13/195,090

(22) Filed: Aug. 1, 2011

(65) Prior Publication Data

US 2013/0031744 A1 Feb. 7, 2013

Related U.S. Application Data

(60) Provisional application No. 61/367,723, filed on Jul. 26, 2010.

(51) Int. Cl.

| | |
|---|---|
| ***A47L 9/20*** | (2006.01) |
| ***A47L 9/10*** | (2006.01) |
| ***A47L 9/14*** | (2006.01) |

(52) U.S. Cl.

CPC . *A47L 9/106* (2013.01); *A47L 9/14* (2013.01); *A47L 2201/024* (2013.01)

(58) Field of Classification Search

CPC ..... A47L 9/14; A47L 9/106; A47L 9/2873
USPC ..... 15/352
IPC ..... A47L 9/20
See application file for complete search history.

(56) References Cited

U.S. PATENT DOCUMENTS

| | | | | |
|---|---|---|---|---|
| 2,757,859 | A * | 8/1956 | Holland | 232/43.2 |
| 5,787,545 | A | 8/1998 | Colens | |
| 6,076,226 | A | 6/2000 | Schaap | |
| 6,327,741 | B1 | 12/2001 | Schaap | |
| 7,053,578 | B2 | 5/2006 | Diehl et al. | |
| 8,756,751 | B2 * | 6/2014 | Jung et al. | 15/319 |

FOREIGN PATENT DOCUMENTS

JP 402215602 A * 8/1990

* cited by examiner

*Primary Examiner* — David Redding

(57) ABSTRACT

An objective of the invention is to eliminate the need of a frequent dust waste by the user and to provide efficient device for wasting the dust that has been collected in the robot cleaner. The invention provides a robot cleaner capable of discharging dust out to a dust discharge station, wherein the robot cleaner is capable of moving autonomously to collect dust, the robot cleaner comprising: a dust container for storing dust; a dust inlet for collecting dust into the dust container; and an opening and closing mechanism of the dust container, provided at a bottom surface of the robot cleaner, for discharging dust collected in the dust container.

9 Claims, 17 Drawing Sheets

(A)

(B)

(A)

(B)

(A)

(B)

(C)

(A)

(B)

ROBOT CLEANER AND DUST DISCHARGE STATION

CROSS-REFERENCE TO RELATED APPLICATIONS

This application claims benefit of a Provisional Application No. 61/367,723, filed on Aug. 1, 2010.

FIELD OF THE INVENTION

The present invention relates to a robot vacuum cleaner capable of discarding ash easily and a dust discharge station thereof.

BACKGROUND ART

A robot cleaner cleans floors in a house autonomously and is expected to be a very useful device that may replace a substantial portion of conventional non-robot vacuum cleaners. Conventional systems are proposed which deal with wasting dust in robot cleaners.

U.S. Pat. No. 5,787,545 describes a system including a discharge unit for discharging dust from a robot cleaner. U.S. Pat. No. 7,053,578 describes a system that discharges dust from the bottom of the robot cleaner using a suction-extraction assembly that generates negative pressure in a charging station. U.S. Pat. Nos. 6,076,226 and 6,327,741 describe systems that collect dust from above the robot cleaner driven by a central processing unit.

SUMMARY OF THE INVENTION

The above conventional systems need relatively complex devices inside and apparently need to generate negative pressure in a part of the station to collect dust in the robot cleaner. Further, the way for the user to discard dust from the station is similar to ordinary vacuum cleaner in spite of the dust being already collected in the robot cleaner.

Furthermore, it is difficult to discharge dust completely in a multi-stage cyclone cleaner.

Compared with ordinary non-robot vacuum cleaners, there are the following problems associated with a robot cleaner.

(1) need of a frequent dust waste by the user due to small dust capacity (2) easy to waste dust from a dust container (3) low suction power The above conventional systems do not solve all of the above problems well.

An objective of the present invention is to solve the above problems (1) to (3) well and to eliminate the need of a frequent dust waste by the user and to provide efficient device for wasting the dust that has been collected in the robot cleaner. The present invention also provides a multi-stage cyclone cleaner that can discharge dust excellently.

The apparatus of the present invention have elements as described in the claims.

According to an aspect of the invention, there is provided a robot cleaner capable of discharging dust out to a dust discharge station, wherein the robot cleaner is capable of moving autonomously to collect dust, the robot cleaner comprising: a dust container for storing dust; a dust inlet for collecting dust into the dust container; and an opening and closing mechanism of the dust container, provided at a bottom surface of the robot cleaner, for discharging dust collected in the dust container.

According to an aspect of the invention, there is provided a dust discharge station capable of collecting dust from a vacuum cleaner, comprising: a vacuum cleaner pedestal for providing a pedestal for the vacuum cleaner and locating the vacuum cleaner at a dust discharge position; a dust receiver provided at the vacuum cleaner pedestal and adapted to receive dust from the vacuum cleaner at the dust discharge position; and a container holder located beneath the dust receiver, for holding a station dust container; and wherein the dust discharge station receives dust collected by the vacuum cleaner from the vacuum cleaner as a result of at least a gravity force and stores into the station dust container by providing a path of dust by the dust receiver and the station dust container.

According to an aspect of the invention, there is provided a multi-stage cyclone cleaner comprising: a first cyclone having a floor air inlet and an outlet at center of the first cyclone, for separating dust; a plurality of second cyclones for separating relatively smaller dust than the first cyclone, wherein each of the second cyclones is smaller than the first cyclone, and air from the outlet of the first cyclone is supplied into inlets of the second cyclones; and a dust discharge enhancing mechanism for enhancing a removal of dust inside the dust container, selected from a group consisting of a blower, a shake mechanism, and an agitator.

DETAILED DESCRIPTION OF THE INVENTION

The present invention will be described with reference to the drawings. Identical or similar elements are numbered the same or similar numbers.

(1) Overall System

Figure 1:
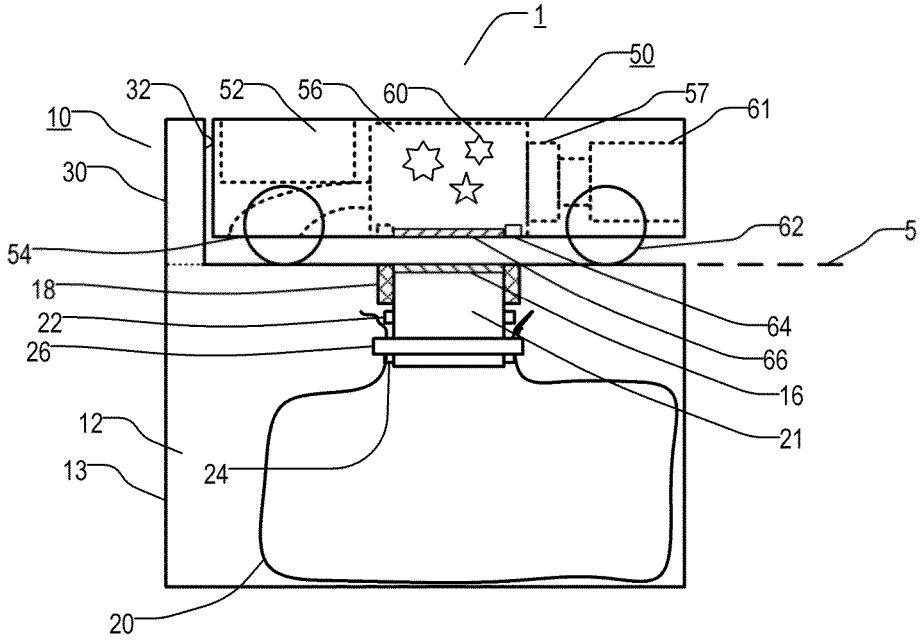
FIG. 1 shows a partially cross-sectional side view of a robot cleaner system 1 according to an embodiment of the invention.

FIG. 1 shows a side view of a robot cleaner system 1 according to an embodiment of the invention.

The robot cleaner system 1 includes a robot cleaner station 10 and a self-propellable robot cleaner 50 for cleaning floors 5 of the user's house.

The robot cleaner station 10 serves as a recharging station and a dust discharging station for the robot cleaner 50, which comes to the robot cleaner station 10 autonomously or when it is ordered so via a remote controller.

(2) Robot Cleaner Station 10

The robot cleaner station 10 includes a dust collecting system 12 and a battery charging device 30 on top of the dust collecting system 12. The battery charging device 30 has a contact 32 for charging a rechargeable battery 52 in the robot cleaner 50. Alternatively, the battery charging device 30 may be a non-contact charging device using a coil for inducing electro-magnetic field.

The dust collecting system 12 includes a casing 13, a cover 16, a dust wall 18, a conduit 21, a station dust container 20, a dust container holder including a holder piece 26, an upper holder piece fastener 22, and a lower holder piece fastener 24. In this case, the station dust container 20 is a plastic bag to be disposed each time.

Using a disposable plastic bag is advantageous because the user can discard the plastic bag to the garbage area without handling the dust any more. Alternatively, the station dust container 20 may be a hard plastic container where the user can set a disposable plastic bag inside. This is advantageous for the plastic bag to not explode even when the plastic bag is full. It may be also advantageous for limiting the volume of the station dust container 20 when a stream of air blow is used to create a cyclone centrifugal system in the station dust container 20 to collect the dust in the station dust container 20.

When the station dust container 20 is close to full, the user disengages the station dust container holder for discarding the plastic bag to the garbage area.

Figure 12:
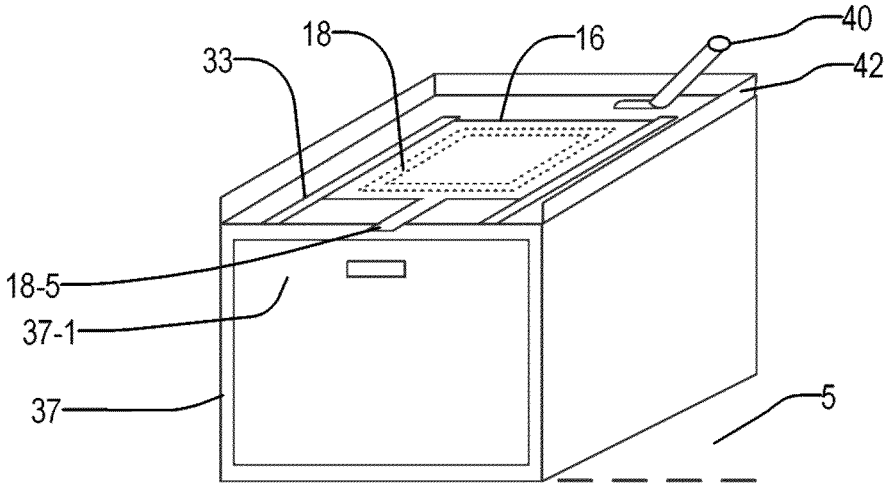
FIG. 12A shows a perspective view of a manual dust discharging system according to an embodiment of the invention.
FIG. 12B shows a perspective view of rail guides on the manual dust discharging system in FIG. 12A.
Figure 12:
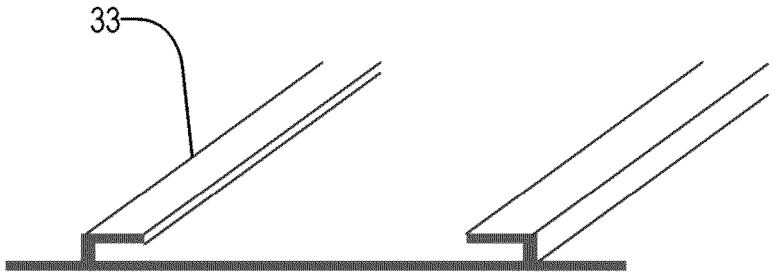

Preferably, the level of the top surface of the dust collecting system 12 is substantially the same as the level of a floor 5 to be cleaned so that the robot cleaner 50 can easily return to the top surface of the dust collecting system 12. To achieve this, the dust collecting system 12 has adjustable legs made of multiple poles and joints. This is advantageous in point of adjusting to floors of various users. The dust collecting system 12 may have a door (as in FIG. 12) to house the station dust container. In addition, the dust collecting system 12 may have a shape to set the system in steps of stairs to downstairs.

(3) Robot Cleaner 50

The robot cleaner 50 is a self-propellable autonomous vacuum cleaner that cleans floor 5 by itself instead of an operation by a person. Examples of a similar robot cleaner include Roomba series released by iRobot Inc. The robot cleaner 50 includes a housing, three tires 62, a dust inlet 54, a cleaner dust container 56, a dust container cover 66, a dust wall receiver 64, a dust filter 57, a motor and fan unit 61, and air outlet.

The robot cleaner 50 collects dust 60 (Herein, dust includes any substance subjected to be collected by a robot cleaner.) using a negative pressure generated by the motor and fan unit 61 via the dust inlet 54 into the cleaner dust container 56.

The cleaner dust container 56 is smaller than an ordinary vacuum cleaner because the robot cleaner 50 needs to be small due to cleaning small areas and to last the battery for a long time. That is, generally, the need to discard the dust from the cleaner dust container 56 is severe in a robot cleaner than in an ordinary vacuum cleaner.

A motor in the motor and fan unit 61 rotates a fan to generate a negative pressure at the dust inlet and the cleaner dust container 56 and keeps dust in the cleaner dust container 56 by separating dust from air with a filter 57.

Alternatively, the separation may be done using a cyclone mechanism that separates dust from air using a centrifugal force, as will be described later.

The motor is powered by a rechargeable battery. Therefore, the robot cleaner 50 needs the robot cleaner station 10 to recharge the battery.

(4) Discharge Mechanism

Figure 2:
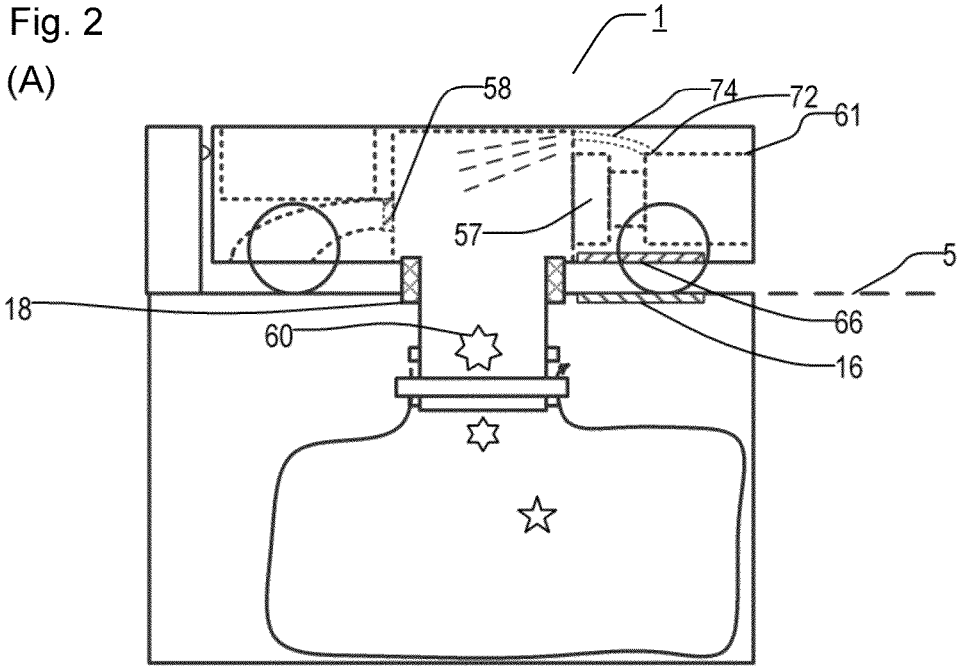
FIG. 2A shows a partially cross-sectional side view of a robot cleaner system 1 according to an embodiment of the invention upon the dust discharge and a cover of the robot cleaner system.
FIG. 2B shows a side view of a dust inlet valve in the robot cleaner in its closed state in detail.
Figure 2:
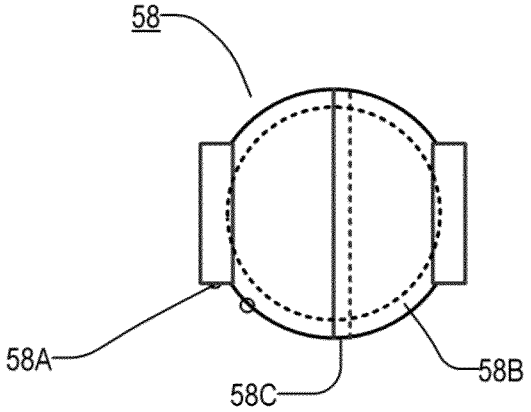

FIG. 2A shows a side view of a robot cleaner system 1 in FIG. 1 upon the dust discharge.

When the robot cleaner 50 returns to the robot cleaner station 10 autonomously or by being carried by the user, the recharging device recharges the robot cleaner 50 and discharges the dust contained in the cleaner dust container 56. The cover 16 located at the top surface of the dust collecting system 12 is opened automatically or by the operation of the user. Then, the dust collecting system 12 raises the dust wall 18 onto a bottom surface of the robot cleaner 50 in order to avoid the dust going outside into an open air, that is, the dust wall 18 maintains seal. In this embodiment, the dust wall 18 moves into a groove (not illustrated) formed at the bottom surface of the robot cleaner 50 in order to make sure that the dust does not go outside into an open air.

Meanwhile, the robot cleaner 50 opens the cover 66 to discharge the dust. The dust receiver, which is the dust wall 18, receives the dust. The dust falls downwards into the station dust container 20 via the conduit 21 of the dust collecting system 12 as a result of at least a gravity force.

Upon this discharging process, at a state where the dust inlet valve 58 is shut, the robot cleaner 50 may blow air with one or more blowers 74. FIG. 2B shows the dust inlet valve 58 in its closed state in detail. The dust inlet valve 58 preferably has a one-way mechanism, which opens the air path one way. The one-way mechanism preferably uses one or more hinges, which opens the air path only when there is negative pressure in the cleaner dust container 56 and not when the blower 74 is blowing. In FIG. 2B, the dust inlet valve 58 has two plates 58B and two hinges 58A, wherein the two plates 58B form an overwrapped area 58C in order to provide good seal between the plates 58B.

The blow energy of the blower 74 may be supplied using a blow mechanism dedicated for the blower 74. Preferably, air is blown in pulse of 0.1 seconds to 5 seconds in order to decrease an overall amount of air blown so as to improve the blowing force, to prevent the station dust container 20 from explosion, and to save energy. Alternatively, the blow energy of the blower 74 may be supplied using the motor and fan unit 61 in order to more completely discard the dust. This may be achieved by stopping most of the air flow from the motor to the filter 57 using a valve mechanism, opening a valve 72 for an air path from the motor into the cleaner dust container 56, and reversely rotating the fan at the motor and fan unit 61. Therefore, the dust adhered onto the filter 57 from the cleaner dust container 56 side can advantageously be blown back into the cleaner dust container 56 (see FIG. 3A).

Figure 3:
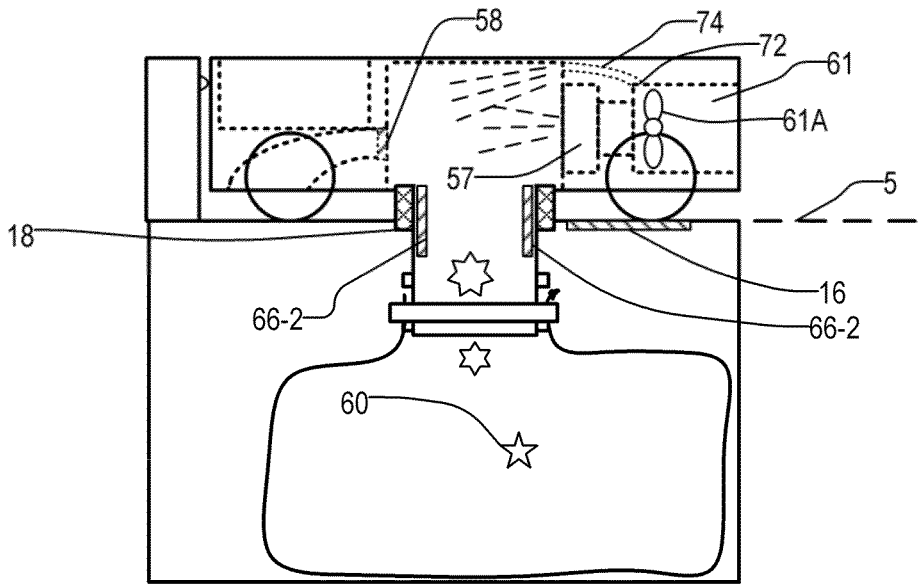
FIG. 3A shows a partially cross-sectional side view of a robot cleaner system 1 according to an embodiment of the invention in which a valve is placed at a side of a filter from the fan and dust adhered onto the filter from the cleaner dust container side is blown back into the cleaner dust container.
FIG. 3B shows a partially cross-sectional side view of a robot cleaner system 1 according to an embodiment of the invention in which a valve is placed at a side of an exit of the air flow where a final filter is located, from the fan.
Figure 3:
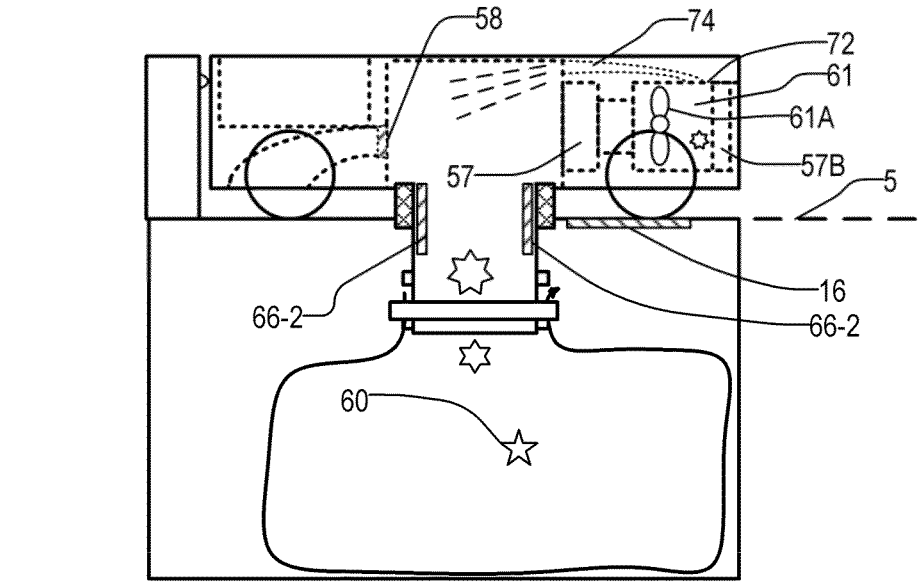

In FIG. 3A, the valve 72 is placed at a side of the filter 57 from the fan 61A. Alternatively, the valve 72 may be placed at a side of an exit of the air flow where a final filter 57B is located, from the fan 61A. In this case, the robot cleaner 50 can have a mechanism to blow small dust adhered around or at the final filter 57*b* to the dust container 56 via the valve 72 and the blower 74.

Further, the robot cleaner 50 may shake itself so as to support the discharging process. The shake may be done by an electrically-powered shake unit or by moving the robot cleaner 50 forward and backwards many times using the tires or by shaking the tires, or by making the robot cleaner 50 hit onto a wall in the robot cleaner station 10.

The robot cleaner 50 may have an agitator comprised of a flexible string for removing dust in the cleaner dust container 56. Preferably, the agitator is a 100 mm long bundle of (ten) plastic fibers, each fiber having a diameter of 0.3 mm. Refer to an agitator 19-3 in FIG. 16. The agitator rotates to move like a whip, to thereby remove dust that is adhered onto the walls inside the cleaner dust container.

Figure 4:
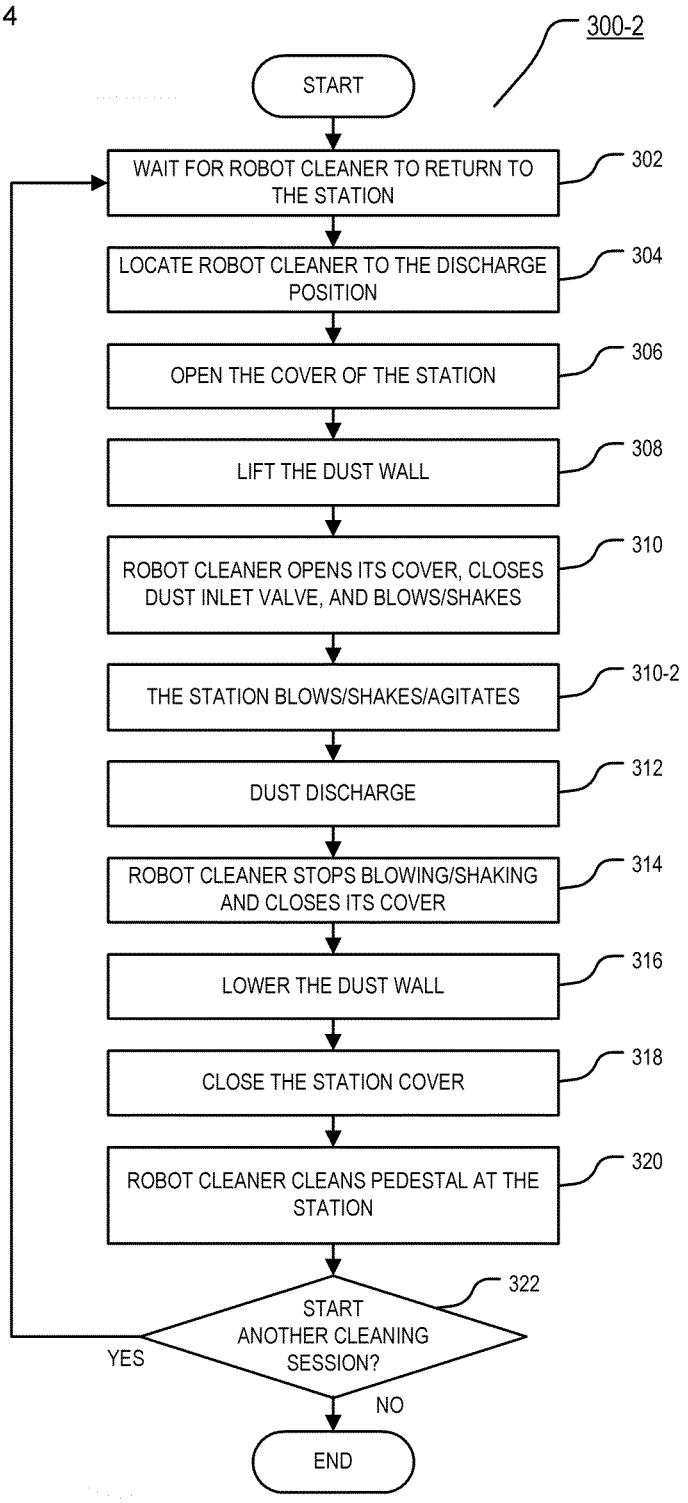
FIG. 4 shows a flow chart of the discharge process.

FIG. 4 shows a flow chart of the discharge process. The robot cleaner station 10 waits for the robot cleaner 50 to return to the station (Step 302). The station, the robot cleaner, and/or the user locates the robot cleaner to the discharge position (Step 304). The station, the robot cleaner, and/or the user opens the cover of the station (Step 306). The station, the robot cleaner, and/or the user lifts the dust wall at the station (Step 308). The station, the robot cleaner, and/or the user opens the cover of the robot cleaner, closes the dust inlet valve, and blows air or shakes the dust container in the robot cleaner (Step 310). Dust is discharged (Step 312). Blowing/shaking is stopped and the cover is closed (Step 314). The dust wall is lowered, that is, stored (Step 316). The station cover is closed (Step 318). The robot cleaner cleans pedestal of the station, that is, the top surface of the station (Step 320). If another cleaning session is programmed or is desired by the user, the robot cleaner starts another cleaning session (Step 322).

(5) Dust Inlet as Dust Outlet

Figure 5:
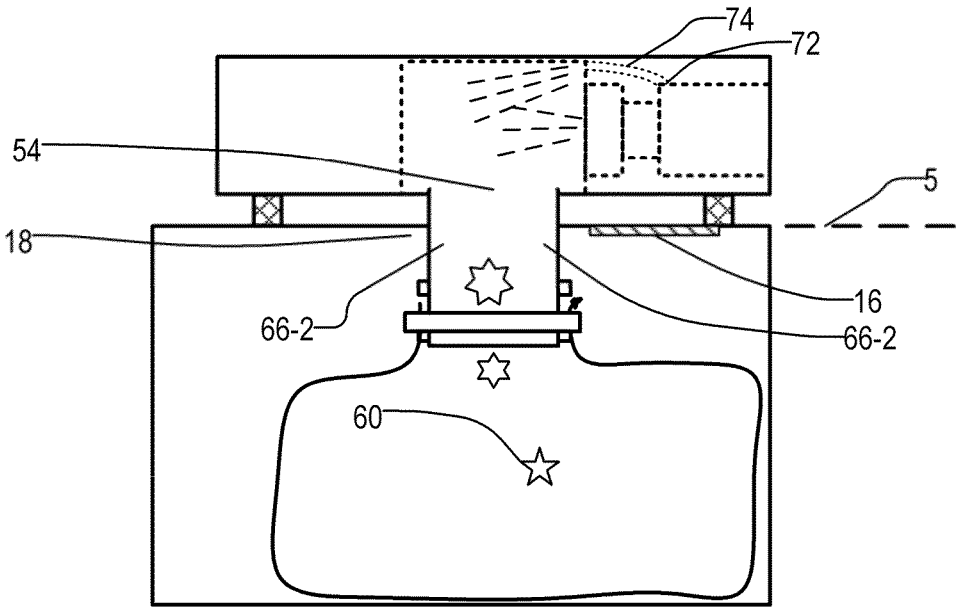
FIG. 5 shows a partially cross-sectional side view of a robot cleaner system according to an embodiment of the invention, wherein the dust inlet is also used as a dust outlet.

FIG. 5 shows a side view of a robot cleaner system according to an embodiment of the invention, wherein the dust inlet is also used as a dust outlet.

Instead of discharging dust from an opening of the cleaner dust container 56 provided in addition to the dust inlet 54, the dust may be discharged from a dust inlet 54, which serves as an opening of the cleaner dust container 56 in addition to an opening for collecting dust from the floor 5. This approach is advantageous in that there is no need for a complex structure. Of course, the dust inlet 54 has a mechanism to prevent the collected dust from falling down onto the floor 5 from the cleaner dust container 56 when collecting dust from the floor. Upon discharging dust from the cleaner dust container 56, the robot cleaner 50 blows air hard using the blower 74 and/or shakes the robot cleaner 50 itself.

(6) Cover Using Two Cover Plates

Figure 7:
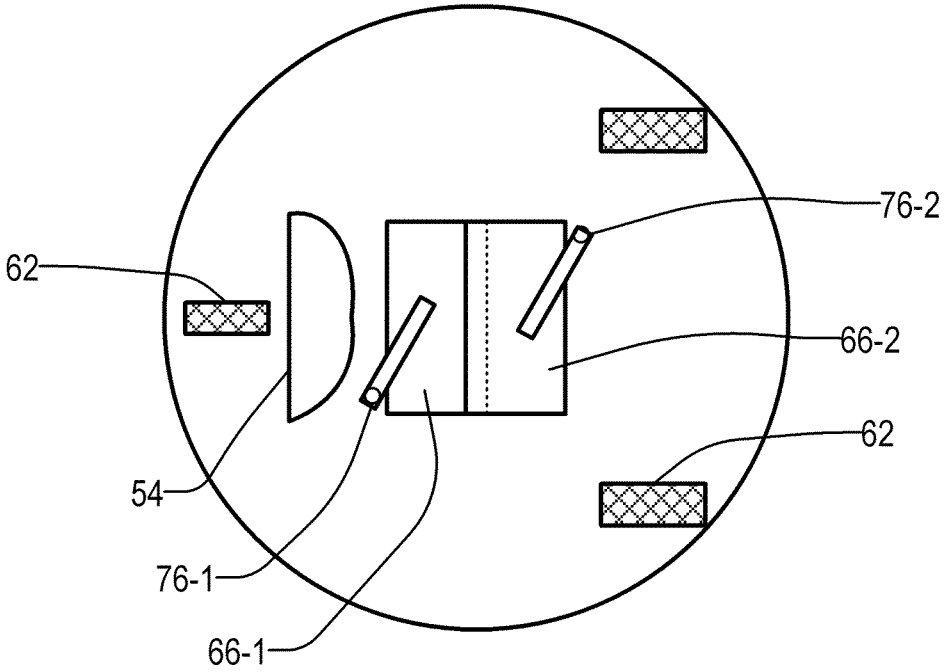
FIG. 7 shows a bottom surface of the robot cleaner 50.

FIG. 7 shows a bottom surface of the robot cleaner 50.

At the bottom surface of the robot cleaner 50, there are three tires, a cover including a first plate and a second plate, and a first assist bar and a second assist bar. The first plate and the second plate are overlapped at its center where there is a seal member (not illustrated) also. A (right) side of the first plate and a (left) side of the second plate are fastened to the robot cleaner 50 using hinges. Other side may be locked but can be separated from the robot cleaner 50 when opening the cover from the center.

When the cover plates are opened using opener bars (not illustrated) to unlock mechanisms, they open at directions substantially 90 degrees from the closed position so as the dust not to stick onto the cover. Upon closing the cover plates when the dust discharge is finished, closing bars may be used to close the cover plates and to lock the cover plates onto their locked positions.

(7) Cover Using Fan-shaped Cover Plates

Figure 8:
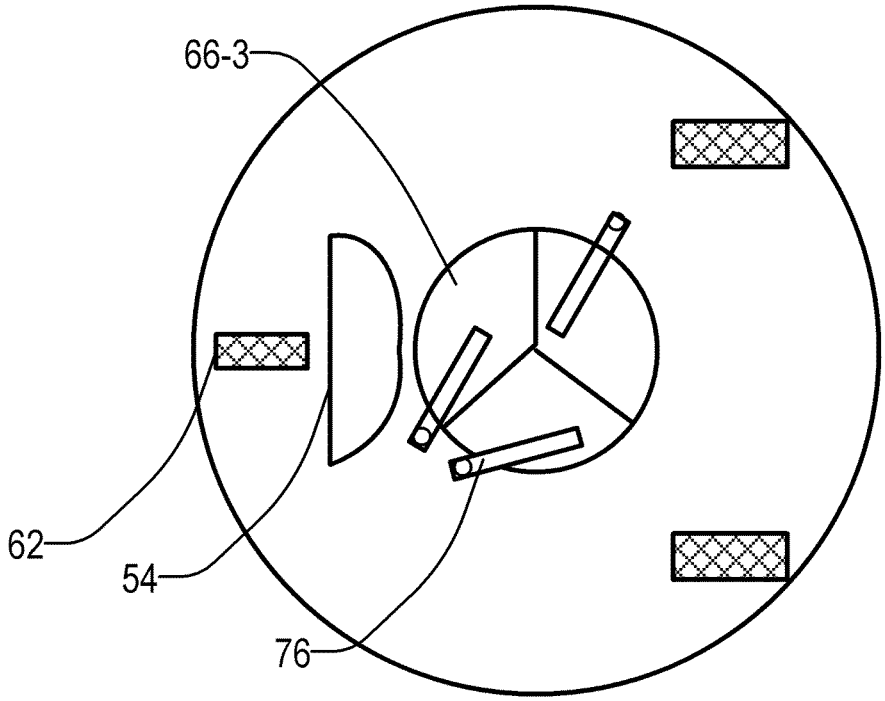
FIG. 8 shows a bottom view of a robot cleaner of the invention using fan-shaped cover plates.

FIG. 8 shows a robot cleaner of the invention using fan-shaped cover plates.

This approach uses three fan-shaped cover plates with three closer bars. This cover is especially advantageous in a cyclone vacuum cleaner for which the cleaner dust container 56 has a circular shape cross section (that is, a cylinder shape) and circular cover is desirable in order to efficiently discharge dust. The fans open as in a lens cover, which is automatically opened and closed, for digital cameras, such as LC-1 for Ricoh GX 200 released by Ricoh Co. Ltd. Instead of three fans, two, four, five, six, fans may be used. Among those, two fans or three fans are preferable. Alternatively, only one circular cover that has a hinge structure at one side may be used.

(8) Cover Using Two Rails

Figure 9:
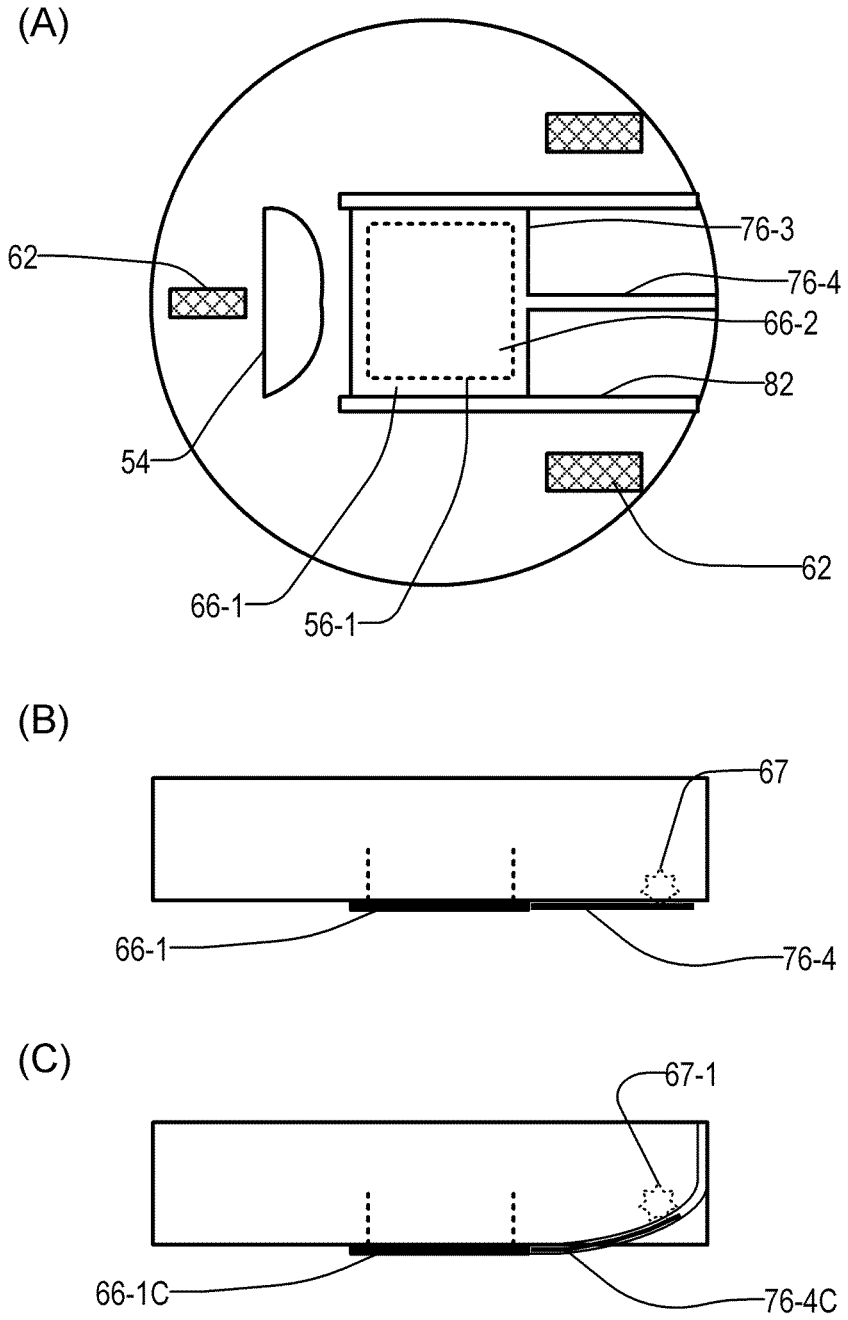
FIG. 9A shows a bottom view of a robot cleaner according to an embodiment of the invention, wherein a rectangular cover plate and two rail guides are used.
FIG. 9B shows a side view of the robot cleaner in FIG. 9A.
FIG. 9C shows a side view of a robot cleaner according to another embodiment.

FIG. 9A shows a robot cleaner according to an embodiment of the invention, wherein a rectangular cover plate and two rail guides are used. FIG. 9B shows a side view of the robot cleaner in FIG. 9A. FIG. 9C shows a side view of a robot cleaner according to another embodiment.

This approach uses a substantially rectangular cover plate 66-2, which is engaged into two rail guides 82. The cover plate 66-2 has a pull/push member 76-4. The cover plate 66-2 contacts to the robot cleaner 50 via a rectangular-shaped seal element (not illustrated). The seal element may be a hollow rubber, such as a weather-strip used to seal between a glass panel and a main frame in aftermarket sunroofs for automobiles, such as Event 450 series released by Signature Automotive Products (Wixom, Mich., USA). The hollow rubber can be pressed down while maintaining the seal, and is durable for horizontal movement of the cover plate.

The arrangement of the two rail guides 82 may be as the same as an arrangement of rail guides 33 in FIG. 12B.

When opening the cover plate 66-2, the cover plate 66-2 is guided by the two rail guides 82 to an open position at the right. This approach is advantageous for a secure closure. The pull/push member 76-4 may be pulled and pushed manually by the user from above the robot cleaner 50. Alternatively, the pull/push member 76-4 may be pulled and pushed automatically using a gear mechanism 67 (see FIG. 9B) that engages with teeth created on the pull/push member 76-4.

The pull/push member 76-4C in FIG. 9C is guided inside the robot cleaner into a route directing upwards as compared to that of FIG. 9B. The route reaches to the top surface of the robot cleaner, enabling the pull/push member 76-4C to project outside. The gear 67-1 drives the pull/push member 76-4C. This embodiment is advantageous in that the guide of the pull/push member 76-4C is hidden from outside. All of these mechanisms for opening and closing the cover at the robot cleaner 50 may be used for opening and closing the cover at the robot cleaner station 10. Details are not shown for simplicity.

Figure 10:
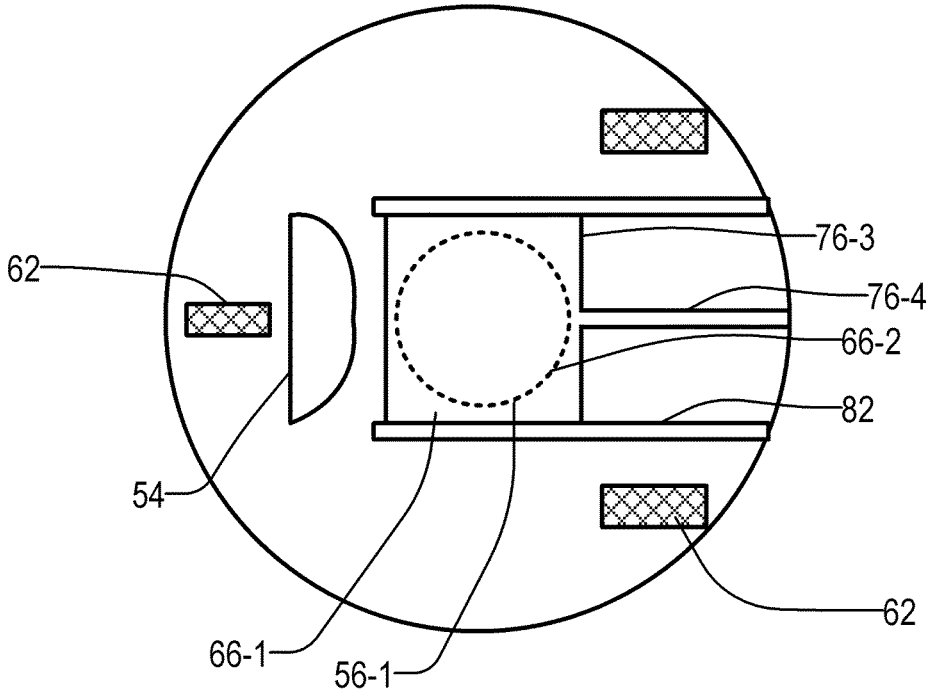
FIG. 10 shows a bottom view of a robot cleaner having a circular cross section dust container 56-1.

FIG. 10 shows a bottom view of a robot cleaner having a circular cross section dust container 56-1. In FIG. 10, the robot cleaner has three tires 62, an inlet 54, a rectangular shaped cover 66-1, a dust container 56-1, which has a circular cross section, two rail guides 82, pull/push member 76-4. A circular cross section dust container is advantageous in that the dust falls easily due to a uniform round shape of the wall of the dust container.

Figure 11:
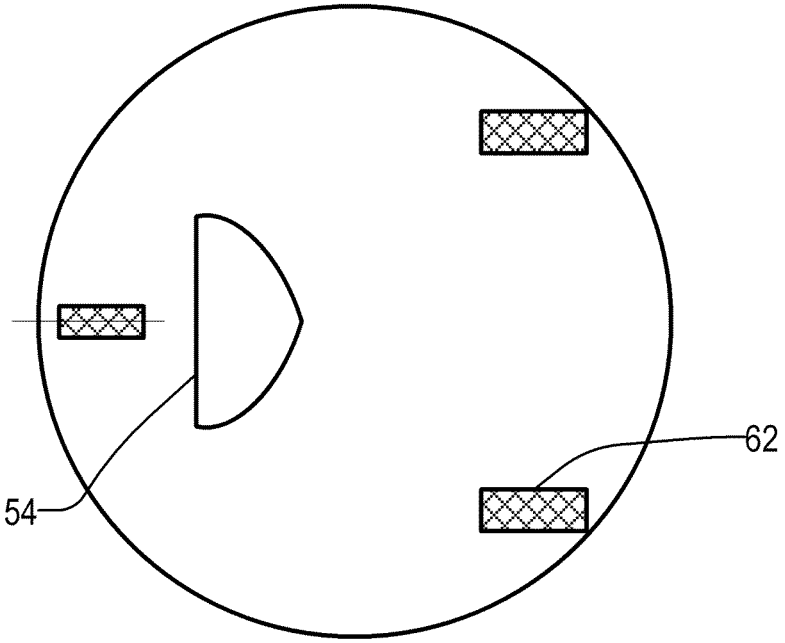
FIG. 11 shows a bottom view of a robot cleaner having the dust inlet 54 also serves as a dust outlet.

FIG. 11 shows a bottom view of a robot cleaner having the dust inlet 54 also serves as a dust outlet. In FIG. 11, dust is collected via the dust inlet 54 when cleaning the floor, and dust is discharged via the dust inlet 54, which also serves as a dust outlet. In order to achieve this feature, the robot cleaner needs the dust discharge enhancing mechanism because the dust should not fall down easily when the robot cleaner is cleaning the floor. This approach is advantageous in that the structure is simple.

(9) Dust Discharge in Multi-Stage Cyclone Cleaner

Figure 6:
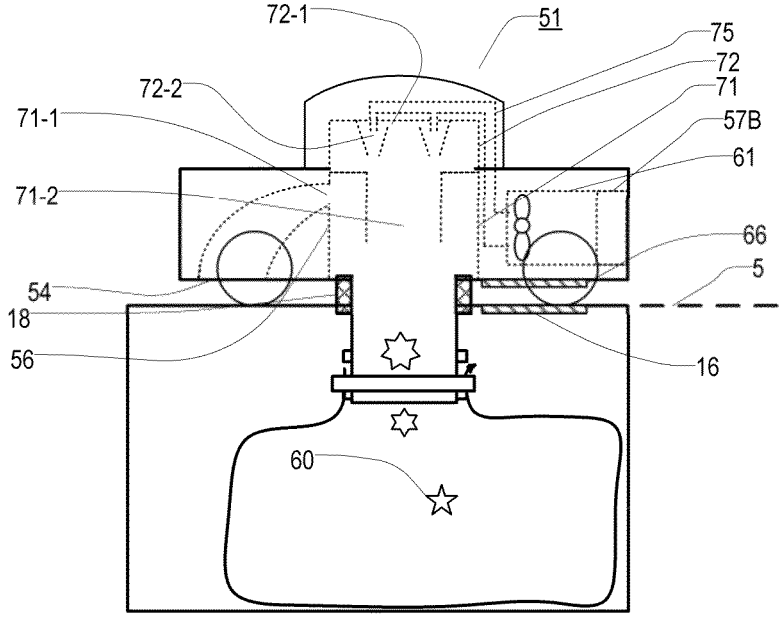
FIG. 6A shows a partially cross-sectional side view of a multi-stage cyclone cleaner and a cleaner station according to an embodiment of the invention.
FIG. 6B shows a partially cross-sectional side view of a multi-stage cyclone cleaner according to an embodiment of the invention wherein the fan and the motor are located upward of the first and second cyclones.
FIG. 6C shows a partially cross-sectional side view of a multi-stage cyclone cleaner according to an embodiment of the invention wherein the fan is located upward of the first and second cyclones but the motor is located at the center of the first cyclone and under the second cyclones.
Figure 6:
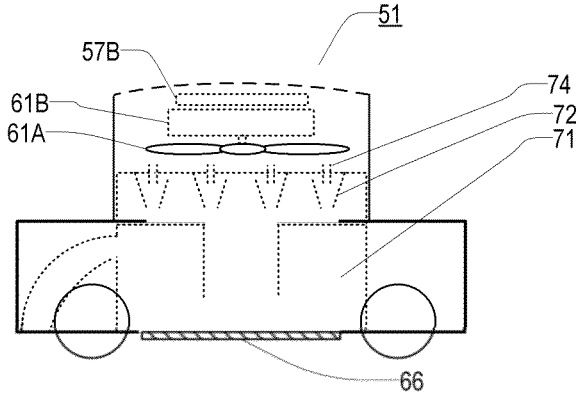
Figure 6:
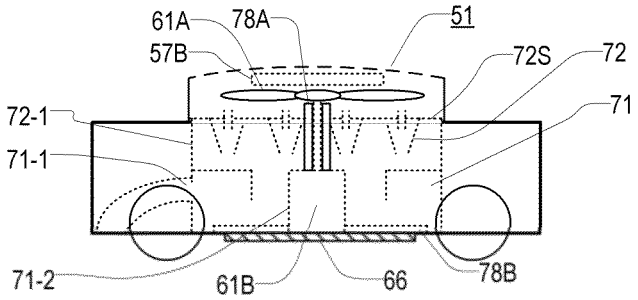

FIG. 6A shows a multi-stage cyclone cleaner 51 according to an embodiment of the invention when discharging dust. The multi-stage cyclone cleaner 51 is a robot cleaner which cleans floor autonomously.

The multi-stage cyclone cleaner 51 separates dust using cyclones where dust keeps away from the center of the cyclone due to centrifugal force generated by rotation of air flow. An example of a multi-stage cyclone cleaner is DC26 released by Dyson Technology Ltd.

The multi-stage cyclone cleaner 51 has a first cyclone 71, which is for generating a first cyclone air flow around the first cyclone 71, and a plurality of second cyclones 72 (six in this embodiment), each of which generates a second cyclone air flow and is smaller than the first cyclone 71. The first cyclone air flow is generated because negative pressure is generated at a side of the second cyclones 72 and incoming air is supplied from a first cyclone inlet 71-1. Floor air including dust enters into the cleaner 51 via an inlet 54, and then enters into the first cyclone inlet 71-1, and into the first cyclone 71, where it separates relatively large dust from air. Relatively clean air goes out of the first cyclone 71 from its center 71-2 to enter into inlets 72-1 of the multiple second cyclones 72.

The second cyclones 72 separate relatively smaller dust, such as particles having diameter of 1 to 100 μm. A part of the separated small dust falls down but some stick onto the walls of the second cyclone 72. Relatively clean air goes out of the second cyclone 72 from its center 72-2 to enter into a conduit 75, a filter 57, and then, into a motor and fan unit 61. There may be provided with additional cyclone in the center 71-2 of the first cyclone 71 to improve the dust separation property. In this case, this additional cyclone is a second cyclone and the plurality of cyclones 72 are respectively a third cyclone. The wall structure in the cleaner dust container 56 in the multi-stage cyclone cleaner 51 is relatively complex than a non-cyclone cleaner, and therefore, it is difficult to remove dust in the dust container 56. The first and second cyclones 71, 72 have axes in the vertical direction, and therefore, the cyclone air flows at the first and second cyclones 71, 72 are generated to have vertical axis. This is advantageous because dust adhered onto the walls in the dust container 56 easily falls down at the time when the motor is not running compared with the case where the first cyclone or the second cyclones have axes not in the vertical direction. In this cleaner, there is no need for a filter in front of the fan in the air flow because the dust can be separated well using the first and second cyclones 71, 72. Instead there may be a final filter 57B behind the fan 61A.

When discharging dust in a conventional multi-stage cyclone cleaner, the user opens the cover (corresponding to the cover 66) and uses a gravity force and may shake by oneself to discharge dust into a collector bag. However, since the wall structure in the cleaner dust container 56 in the multi-stage cyclone cleaner 51 is relatively complex than a non-cyclone cleaner, it is difficult to remove dust well.

Therefore, the invention utilizes a dust discharge enhancing mechanism, such as a blower 74, described above, to remove dust at the second cyclone 72. In addition, the invention utilizes a shake mechanism, described above, to remove dust at the second cyclone 72. Furthermore, the invention utilizes an agitator, described above, to remove dust at the second cyclone 72.

FIG. 6A also shows a dust discharge scheme of such a cleaner. Details are not shown for simplicity. Of course, descriptions described for other embodiments can be applied to the multi-stage cyclone cleaner 51 in FIG. 6A. For example, it may be an autonomous robot cleaner, it may have an automatic opening and closing mechanism, and it may have valves described in the above.

(10) Second Embodiment of Multi-Stage Cyclone Cleaner

FIG. 6B shows a multi-stage cyclone cleaner according to another embodiment, wherein the fan 61A and the motor 61B are located upward of the first and second cyclones 71, 72. Accordingly, the filter 58 is located between the second cyclones 72 and the fan 61A. Axes of the first cyclone 71, the fan 61A, and the motor 61B are substantially identical. This cleaner is advantageous because resistance of air flow at the conduit 75 in FIG. 6A, which is relatively very long and thin, can be decreased, the size of the fan 61A can be increased, and the exhaust air can be directed upwards from a relatively large area.

(11) Third Embodiment of Multi-Stage Cyclone Cleaner

FIG. 6C shows a multi-stage cyclone cleaner according to another embodiment, wherein the fan 61A is located upward of the first and second cyclones 71, 72 but the motor 61B is located at the center of the first cyclone 71 and under the second cyclones 72. Since there is no need for the space for the motor 61B above the fan 61A, this approach is advantageous in that the overall height can be lowered as compared with the cleaner in FIG. 6B, enabling the cleaner to go into places of low height. However, there is a need for a longer shaft between the motor 61B and the fan 61A, to fix the motor 61B to the cleaner body, to hold the shaft of the motor 61B with respect to the cleaner body, and to protect the shaft, which may be greased, from dust.

In order to solve the above problems, the cleaner has a motor shaft holder 78A and a motor holder 78B. The motor shaft holder 78A surrounds the motor shaft, which connects the motor 61B and the fan 61A, and is fixed to the surface 72S of the second cyclones 72 and to the motor 61B. Therefore, the motor shaft is substantially not exposed to dust, that is, the motor shaft is exposed to dust at only at a region close to the fan 61A. Preferably, there is a mechanism to reduce the friction between the motor shaft and the motor shaft holder 78A. For example, this mechanism uses a bearing, or low friction plastics. In addition, the motor 61B is supported by a motor holder 78B to the bottom part of the cleaner. Preferably, the motor holder 78 is a plurality of elongate members extending radially from the motor 61B and are fixed to the wall of the dust container 58 and the supporting member of the wall. Even when the motor 61B and the motor holder 78B are located in the dust container close to the cover 66, the cleaner can open the cover 66 and to waste dust because there is a dust discharge enhancing mechanism to drop the dust. It should be noted that the multi-stage cyclone cleaners 51 in FIGS. 6A, 6B and 6C do not need to be used with a dust discharge station such that the user may discharge dust to a garbage can or a plastic bag, preferably with the dust discharge enhancing mechanism being activated to easily discharge dust out of the cleaner.

(12) Manual Dust Discharging System

FIG. 12A shows a manual dust discharging system according to an embodiment of the invention.

Although an automatic robot cleaner system is advantageous to reduce human labor, a manual robot cleaner system is advantageous to provide a simple and robust solution.

The dust collecting system 12 is set on the floor 5 and the top surface of the dust collecting system 12 is higher than the floor 5. With this way, the user does not need to create or find a concave area at the floor 5. When a cleaning session is finished, the robot cleaner 50 is lifted by the user and set to the recharging and discharging position. Fence 42 provided on three edges of the top surface of the dust collecting system 12 helps to locate the robot cleaner 50 to the recharging and discharging position and to prevent the robot cleaner 50 from falling down even if the robot cleaner 50 started to move, and to prevent the dust falling down from the top surface.

The dust collecting system 12 has a pull lid 37 in order to hide the dust collector 20. The pull lid 37 has a hinge mechanism at the bottom side thereof and a pull knob 37-1 at its upper part.

The cover plate 16 and its sealing mechanism are similar to that of the cover 76-3 shown in FIG. 8. There is a sealing element around the retracted dust wall 18 on the top surface of the dust collecting system 12. The sealing element may be a hollow rubber, such as a weather-strip used to seal between a glass panel and a main frame in aftermarket sunroofs for automobiles, such as Event 450 series released by Signature Automotive Products (Wixom, Mich., USA). The hollow rubber can be pressed down while maintaining the seal, and is durable for horizontal movement of the cover plate 16.

The user pulls the pull/push tab 18-5 of the cover plate 16 of the dust collecting system 12 to open the cover of the dust collecting system 12. Then, the user pulls a lever 40 to lift the dust wall 18 to an intermediate position, where the lever 40 is locked temporarily. The lever 40 and the dust wall 18 are mechanically associated with each other by a gear mechanism. Alternatively, the dust wall 18 may be lifted electrically using a motor. Next, while the lever 40 is still at its intermediate position, the user touches a button on the robot cleaner 50 to open the cover of the robot cleaner 50 electrically and to expose a dust wall receiving element 64 of the robot cleaner 50. While the user holding the robot cleaner 50, the user pulls the lever 40 to a discharge position so as to lift the dust wall 18 further and therefore to engage the dust wall 18 to the dust wall receiving element 64.

Then, the robot cleaner 50 blows dust with its blower 74 and/or shakes to discharge dust from the cleaner dust container 56. Upon finishing the dust discharge, the user pushes the lever 40 back and pushes a button on the robot cleaner 50 to cover the cleaner dust container 56. Then, after having the robot cleaner 50 clean the top surface of the dust collecting system 12, the user may finish the robot cleaning, or may lift the robot cleaner 50 and puts it to the floor 5 again for further cleaning.

Although the dust collecting system 12 may operate non-electrically, a part of the functions may operate electrically.

(13) Robot Cleaner-Lifting Dust Collecting System 12

Figure 13:
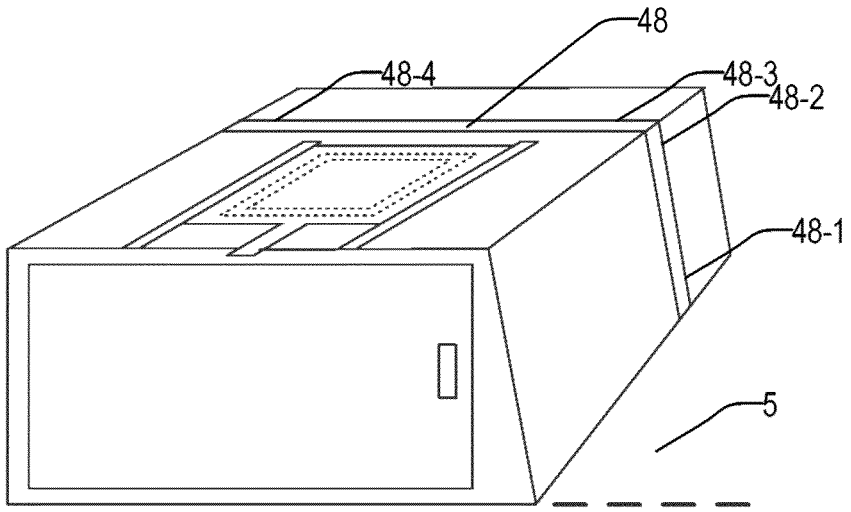
FIG. 13 shows a perspective view of a dust collecting system having a lift mechanism.

When the top surface of the dust collecting system 12 is at a higher level than the floor 5, the robot cleaner 50 needs to be automatically lifted to achieve an automatic discharge system. FIG. 13 shows a dust collecting system having a lift mechanism.

The dust collecting system 12 uses a lift mechanism 48 to hook the robot cleaner 50 and to lift the robot cleaner 50 to the surface of the dust collecting system 12. The hook does not work for an object other than the robot cleaner 50 by a checking mechanism using an authentication technique.

First, the robot cleaner 50 approaches to the lift mechanism 48 by self-propelling on the floor 5. Then, a hook projects at a location 48-1 to hook the robot cleaner 50. Next, the hook moves upwards to a location 48-2. Then, the hook projects from the top surface of the dust collecting system 12 for about a half size of the robot cleaner 50. Then, the hook descends onto the top surface.

(14) Dust Collecting System 12 Having Dust Blower/Agitator/Shake Mechanism

Figure 14:
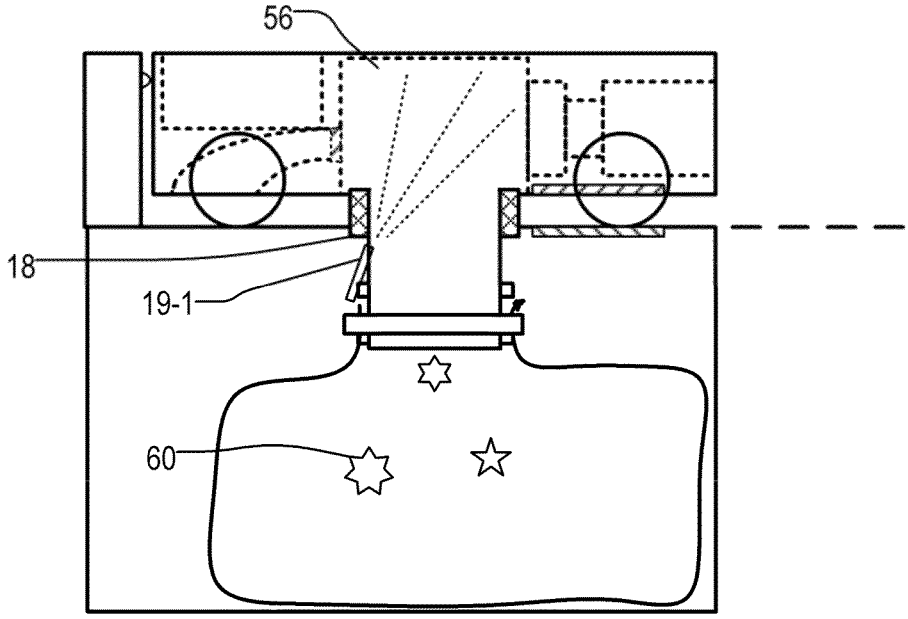
FIG. 14 shows a partially cross-sectional side view of a dust collecting system of the invention having a blower 19-1 for removing dust inside the cleaner dust container 56.

FIG. 14 shows a dust collecting system of the invention having a blower 19-1 for removing dust inside the cleaner dust container 56. This approach is a combination of the dust collecting system 12 and the dust blower 74 of the robot cleaner 50. This approach is advantageous in that complex mechanisms in the robot cleaner 50 are avoided. In addition, this approach is advantageous in that the blowing direction can be from downward of the dust container 56 in the robot cleaner 50 because the dust can be blown better from downward due to the shape of the dust container 56, especially when the robot cleaner 50 is the multi-stage cyclone cleaner 51 shown in FIG. 6A.

Figure 15:
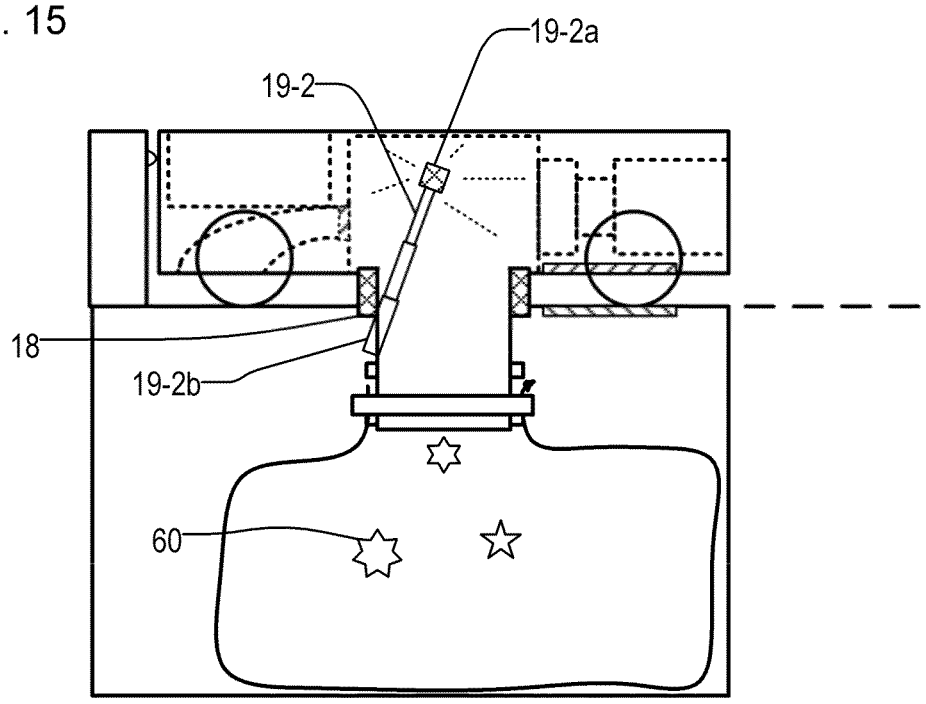
FIG. 15 shows a perspective view of a dust collecting system of the invention having an agitator comprised of a flexible string for removing dust inside the cleaner dust container 56.

FIG. 15 shows a dust collecting system of the invention having an agitator comprised of a flexible string for removing dust inside the cleaner dust container 56. Preferably, the agitator is a 100 mm long bundle of (ten) plastic fibers, each fiber having a diameter of 0.3 mm. The agitator rotates to move like a whip, to thereby remove dust that is adhered onto the walls inside the cleaner dust container 56.

Figure 16:
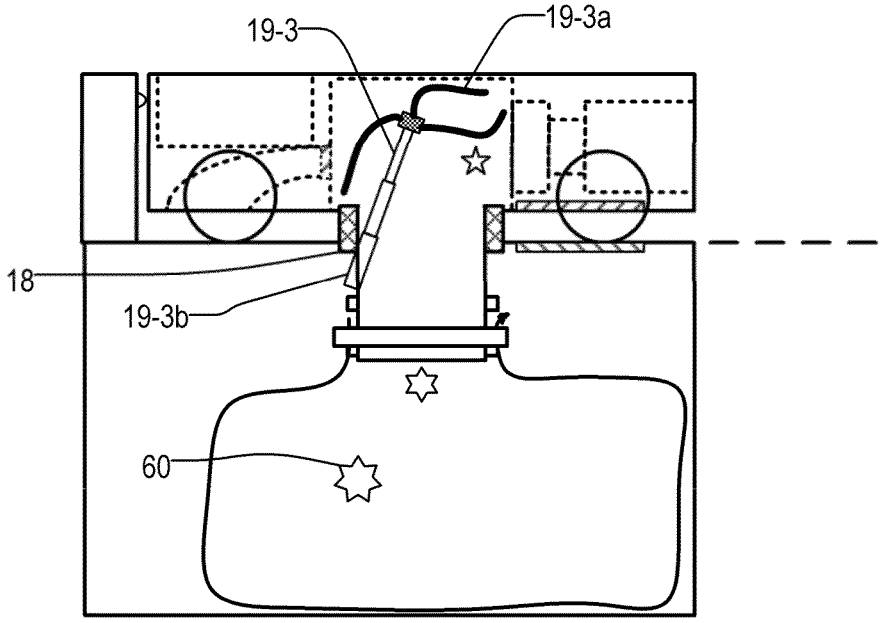
FIG. 16 shows a perspective view of a dust collecting system of the invention having a retractable rotating blower for removing dust inside the cleaner dust container 56.

FIG. 16 shows a dust collecting system of the invention having a retractable rotating blower for removing dust inside the cleaner dust container 56. The retractable rotating blower 19-2 is provided in the dust collecting system 12. The retractable rotating blower 19-2 is usually at its retracted state (not illustrated). Upon blowing air from one or more holes on a blowing rotator 19-2*a*, the retractable rotating blower 19-2 is extended to have a longer length. Blowing air pressure may be used for extending the blower. The blowing rotator 19-2*a* can be rotated around an axis of the blower. When air is blown from the blowing rotator 19-2*a*, the blowing rotator 19-2*a* rotates because of the force generated by the blowing air. A rotating blower is preferable because it is possible to blow a larger area of the walls in the dust container 56.

Each of the blower, the agitator, and the shake mechanism, and the like, in the dust collecting system 12 and in the robot cleaner 20 constitutes a dust discharge enhancing mechanism.

Figure 17:
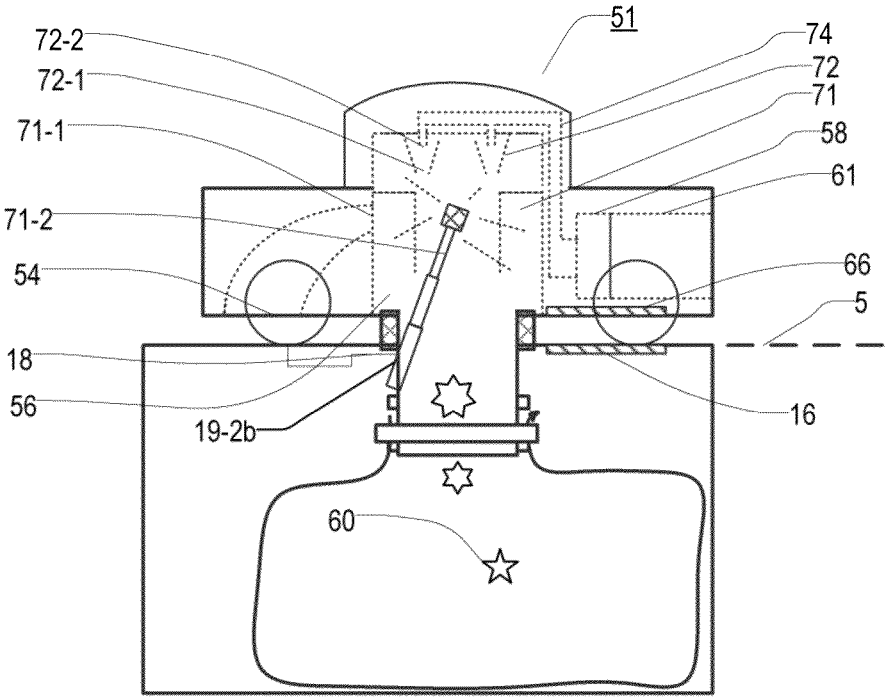
FIG. 17 shows a perspective view of a dust collecting system of the invention having a retractable rotating blower for removing dust inside the cleaner dust container 56 in the multi-stage cyclone cleaner 51 in FIG. 6A.

FIG. 17 shows a dust collecting system of the invention having a retractable rotating blower for removing dust inside the cleaner dust container 56 in the multi-stage cyclone cleaner 51 in FIG. 6A. Since it is difficult to discharge dust completely in a multi-stage cyclone cleaner 51 due to complex walls in the dust container 56, a retractable rotating blower 19-2*b* or other dust discharge enhancing mechanism is especially preferable in a multi-stage cyclone cleaner.

(15) Notes

In the above embodiments of the invention, several embodiments of the dust collecting system 12, the robot cleaner 50, and their components are shown. Although not all of the combinations are described herein, all the combinations of the elements construct embodiments of the invention and are incorporated herein.

What is claimed is:

1. A robot cleaner capable of discharging dust out to a dust discharge station, wherein the robot cleaner is capable of moving autonomously to collect dust, the robot cleaner comprising:

a dust container for storing dust;

a dust inlet for collecting dust into the dust container; and an opening and closing mechanism of the dust container, provided at a bottom surface of the robot cleaner, for discharging dust collected in the dust container, wherein the robot cleaner has a dust discharge enhancing mechanism for enhancing the discharge of dust, and the dust discharge enhancing mechanism is selected from a group consisted of a blower for blowing dust in the dust container and discharging the blown dust into the robot cleaner station, a shake mechanism for shaking dust in the dust container and discharging the shaken dust into the dust discharge station, and an agitator comprised of a flexible string for removing dust from the dust container of the robot cleaner.

2. The robot cleaner according to claim 1, wherein the robot cleaner moves to a dust discharge position in the dust discharge station autonomously.

3. The robot cleaner according to claim 1, wherein the dust discharge enhancing mechanism is a blower for blowing dust in the dust container and discharging the blown dust into the robot cleaner station, and the blower blows air by rotating a fan reversely from a time when the robot cleaner collects dust via the dust inlet.

4. The robot cleaner according to claim 1, wherein the opening and closing mechanism includes: a cover plate for covering an opening of the dust container; and a closing bar for pushing the cover plate and closing the cover plate.

5. The robot cleaner according to claim 1, wherein the opening and closing mechanism includes:

a cover plate for covering an opening of the dust container; and rail guides that engage with the cover plate for guiding the cover plate upon opening and closing of the cover plate.

6. The robot cleaner according to claim 1, wherein the opening and closing mechanism includes a cover plate for covering an opening of the dust container, the cover plate including a pull/push member that is pulled and pushed for opening and closing the cover plate.

7. A robot cleaner capable of discharging dust out to a dust discharge station, wherein the robot cleaner is capable of moving autonomously to collect dust, the robot cleaner comprising:

a dust container for storing dust;

a dust inlet for collecting dust into the dust container; and an opening and closing mechanism of the dust container, provided at a bottom surface of the robot cleaner, for discharging dust collected in the dust container, wherein the opening and closing mechanism includes:

a cover plate for covering an opening of the dust container; and rail guides that engage with the cover plate for guiding the cover plate upon opening and closing the cover plate.

8. The robot cleaner according to claim 7, wherein the cover plate includes a pull/push member that is pulled and pushed for a user of the robot cleaner to pull and push the pull/push member manually to open and close the cover plate.

9. The robot cleaner according to claim 7, wherein the robot cleaner has a dust discharge enhancing mechanism for enhancing the discharge of dust, wherein the dust discharge enhancing mechanism is a blower for blowing dust in the dust container and discharging the blown dust into the robot cleaner station, and the blower blows air by rotating a fan reversely from a time when the robot cleaner collects dust via the dust inlet.

* * * * *